US006541524B2

(12) United States Patent
O'Rear et al.

(10) Patent No.: US 6,541,524 B2
(45) Date of Patent: Apr. 1, 2003

(54) METHOD FOR TRANSPORTING FISCHER-TROPSCH PRODUCTS

(75) Inventors: Dennis J. O'Rear, Petaluma, CA (US); March R. Buetzow, Novato, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 10/011,501

(22) Filed: Nov. 13, 2001

(65) Prior Publication Data

US 2002/0128332 A1 Sep. 12, 2002

Related U.S. Application Data

(63) Continuation-in-part of application No. 09/708,068, filed on Nov. 8, 2000.

(51) Int. Cl.[7] ..... C07C 27/00; C07C 7/20; C10G 35/00

(52) U.S. Cl. ..... 518/700; 578/702; 585/1; 585/899; 208/133

(58) Field of Search ..... 518/700, 702; 585/1, 899; 208/133

(56) References Cited

U.S. PATENT DOCUMENTS 5,292,989 A 3/1994 Davis
5,866,751 A * 2/1999 Womack et al. ..... 585/899
6,123,834 A 9/2000 Kao et al.
6,130,260 A * 10/2000 Hall et al. ..... 518/703
6,294,076 B1 * 9/2001 Genetti et al. ..... 208/24

OTHER PUBLICATIONS

U.S. Patent application No. 09/708,068, Dennis J. O'Rear, et al., *Method for Transporting Fischer–Tropsch Products*, filed on Nov. 8, 2001, attorney docket No. 005950–631.

Jentoft, R.E., et al., *Rapid Determination of the Vapor Pressure of Lubricating Oils and Hydraulic Fluids, Analytical Chemistry*, vol. 40, No. 6, 1968, pp. 1014–1015, American Chemical Society.

* cited by examiner

*Primary Examiner*—J. Parsa
(74) *Attorney, Agent, or Firm*—Burns, Doane, Swecker & Mathis, L.L.P.

(57) ABSTRACT

Facilities to convert natural gas into syncrude often are located at remote sites. At these sites and in their surrounding communities there exists demand for salable products: gasoline, distillate fuels, solvents, lubricants, etc. While it would be possible to produce these products from syncrude, the construction of such production facilities would be very expensive, and their operation would be difficult at the remote site. Fischer-Tropsch syncrude will be waxy and will also contain volatile components, complicating the shipping of both Fischer-Tropsch products from remote production sites to developed sites and salable products from developed sites to remote sites. This invention describes a safe process to both transport Fischer-Tropsch syncrude from the remote site to the developed site and supply salable products from the developed site to the remote site.

27 Claims, No Drawings

METHOD FOR TRANSPORTING FISCHER-TROPSCH PRODUCTS

This application is a continuation-in-part of application Ser. No. 09/708,068, filed Nov. 8, 2000, entitled "Method for Transporting Fischer-Tropsch Products," filed Nov. 8, 2000, the contents of which are hereby incorporated by reference in their entirety.

FIELD OF THE INVENTION

This invention generally relates to Fischer-Tropsch synthesis, and more specifically, to a safe method for both transporting Fischer-Tropsch syncrude from a remote production site to a developed site and supplying salable products from the developed site to the remote site.

BACKGROUND OF THE INVENTION

Crude oil is a mixture of hydrocarbons when it comes out of the ground. Typically, the mixture is separated into at least three fractions, a gas fraction, an intermediate fraction, and a crude oil fraction, which tend to have some degree of overlap. The gas fraction includes mostly $C_{1-3}$ hydrocarbons, the intermediate fraction includes mostly $C_{3-5}$ hydrocarbons, and the crude oil fraction includes $C_{4+}$ hydrocarbons.

Crude oil is often obtained at locations far from where it is ultimately converted into distillate fuel compositions and other products. Crude oil is transported to commercial refineries after the gas and intermediate fractions, and optionally naphtha fractions, have been removed. Crude oil fractions must have a relatively low vapor pressure when they are transported because of safety regulations as well as practical limits on the pumping and storage of volatile crude oil. However, it is common practice to ship crude oil that includes volatile components in concentrations that do not cause the crude oil to exceed the vapor pressure specification or increase the API (American Petroleum Institute) gravity excessively. Petroleum-based crude oil, therefore, typically includes $C_{5+}$ hydrocarbons, with an amount of butane that will not cause the crude oil to exceed the vapor pressure specification. Propane and lighter hydrocarbons are avoided because of their volatility.

The volatility of crude oil in commercial tankers is typically limited to about 9 psia (pounds per square inch absolute) when measured at the shipping temperature. International maritime regulations limit the maximum Reid Vapor Pressure of crude oil carried aboard conventional tankers to "below atmospheric pressure" (i.e., less than 14.7 psia). These same regulations limit the closed cup flash point "not to exceed 60° C." (Safety of Life at Sea (SOLAS), Chapter 22, Regulation 55.1). A practical operational limit is a True Vapor Pressure, not Reid Vapor Pressure, of about 9–10 psia for conventional tankers. A True Vapor Pressure higher than approximately 10 or 11 psia during pumping will make it difficult, if not impossible, to fully discharge the tanker's cargo tanks, although the actual pumping performance will depend on the particular ship. Receiving shoreside terminals commonly have a maximum True Vapor Pressure limit of 11 psia, based on the maximum capability of floating roof storage tanks.

Waxy crude oils typically do not contain significant quantities of volatile components and can be shipped at temperatures up to around 160° F. without exceeding the maximum vapor pressure. Slack waxes from petroleum deoiling and dewaxing operations can also be shipped by tanker in a molten state. These waxes include mostly high molecular weight hydrocarbons and do not typically include significant amounts of volatile light components that would cause problems with excessive vapor pressure when the waxes are molten. Accordingly, a preferred method for transporting such waxes is in the molten state.

Like crude oil, natural gas is often obtained at locations far from where it is ultimately converted. It is often more commercially feasible to convert the natural gas into higher molecular weight hydrocarbons at remote locations than to transport the natural gas to another location for conversion. Many processes, such as Fischer-Tropsch synthesis, can be used to convert methane into higher molecular weight hydrocarbons. Fischer-Tropsch synthesis involves the initial conversion of methane into synthesis gas or "syngas," and the subsequent conversion of syngas into higher molecular weight products. Because it is desirable to limit the amount of processing equipment at remote locations, the Fischer-Tropsch products may be hydroprocessed at commercial refineries far from where the Fischer-Tropsch synthesis is performed.

The products of Fischer-Tropsch synthesis are mostly linear hydrocarbons that often include high melting point wax. A $C_{5+}$ product stream, commonly referred to as "syncrude," can be isolated. At the Mossgas facility in South Africa and the Shell facility in Malaysia, both developed sites with low to moderate capital costs, methane is converted into syncrude, which is refined at the site into finished salable products. When capital costs at remote sites are high, the syncrude could also be transported to commercial refineries for hydroprocessing, for example by hydrocracking, hydroisomerization and hydrotreatment, to produce products with desired properties. This minimizes the construction of expensive facilities at remote sites.

Methods for transporting Fischer-Tropsch derived syncrude from a remote site to a commercial refinery are known in the art. One approach has been to isolate a $C_{20-36}$ syncrude and ship this composition as a solid. A limitation of this approach is that it is difficult and expensive to transport solids, because such transportation requires expensive forming, loading and unloading facilities.

Another approach involves transporting the syncrude as a molten wax. This transportation method does not require the forming, loading and unloading facilities needed to transport solids or the dewaxing facilities needed to convert the syncrude into a product that is liquid at room temperature. However, Fischer-Tropsch products include a sufficient quantity of volatile hydrocarbons that would cause the products to exceed the vapor pressure specifications if the syncrude were shipped at a temperature at which the syncrude is molten.

Other approaches have focused on transporting syncrude, or syncrude that has been partially refined to convert some of the linear hydrocarbons into isoparaffins and thus generate syncrude that is liquid, at near ambient temperature. One approach to transporting syncrude in the liquid state involves partially dewaxing the syncrude to form a pumpable liquid (see, for example, U.S. Pat. No. 5,292,989). However, this dewaxing may require the construction of facilities that are expensive and difficult to operate in remote locations.

There exists demand for salable products, such as gasoline, distillate fuels, solvents, lubricants, etc., both at the remote sites where natural gas is converted into syncrude and in their surrounding communities. Fischer-Tropsch syncrude will be waxy and will also contain volatile components, complicating the shipping of both Fischer- Tropsch products from remote production sites to developed sites and salable products from developed sites to remote sites.

It would be advantageous to provide a safe and efficient method for manufacturing and transporting Fischer-Tropsch syncrude in the liquid state without requiring dexwaxing conditions and without exceeding the vapor pressure specifications in the transportation method from remote production sites to developed sites and supplying salable products from developed sites to remote sites. The present invention provides such a process.

SUMMARY OF THE INVENTION

A novel transportable Fischer-Tropsch liquid syncrude and a safe and efficient method to manufacture and transport the product from a remote production site to a developed site and to supply salable products from the developed site to the remote site are disclosed.

The novel Fischer-Tropsch liquid syncrude, which may be produced at a remote site, differs from conventional Fischer-Tropsch liquid syncrude that contains both volatile and waxy components wherein the mixture has a true vapor pressure in excess of about 15 psia when measured at the transportation temperature.

The method of the invention involves converting a light hydrocarbon feedstock into syngas, converting the syngas into syncrude via Fischer-Tropsch synthesis, and separating the Fischer-Tropsch liquid syncrude into at least one waxy fraction, with a pour point in excess of 20° C., and at least one non-waxy fraction. The fractions have true vapor pressures of less than about 15 psia, preferably less than 11 psia, when measured at their transportation temperature and contain greater than 60%, preferably greater than 75%, linear hydrocarbons by weight. At least two of the fractions, including at least one non-waxy fraction, are supplied to a vessel in substantially liquid form, wherein they are separately transported to a developed site where they are unloaded.

A $C_{1-2}$ fraction can also be isolated from the Fischer-Tropsch synthesis and recycled upstream of syngas generation, flared, used to produce hydrogen, and/or used for fuel. A $C_3$-enriched fraction, including more than 5% by weight $C_3$, preferably more than 20% by weight $C_3$, and most preferably more than 40% by weight $C_3$, can also be obtained. This fraction can be recycled upstream of syngas generation, flared, used for fuel, transported in pressurized tankers, and/or transported in refrigerated tankers.

In a preferred process and business method embodiment, petroleum products such as crude oil can be blended with one or more of the transportable Fischer-Tropsch products, so long as the resulting blended composition has a true vapor pressure of less than about 15 psia, preferably less than 11 psia, when measured at its transportation. The resulting composition preferably has a pour point in excess of 20° C. The blending of fractions can occur at any site: the remote Fischer-Tropsch site, a lube manufacturing site, a distillate refinery site, or another location.

The products can be transported using any commonly used means of transportation, including marine tankers, rail cars, pipelines, trucks, barges and combinations thereof. A preferred means of transportation is a marine tanker. Whether transported by marine tanker, rail, truck, and/or barge, each transportable product is transported either in a separate marine tanker, rail, truck, or barge, or in a separate zone, isolated by internal partitions, for each transportable product within the same marine tanker, rail, truck, or barge.

After unloading the separate fractions at the developed site, at least one vessel or portion of a vessel that contained a non-waxy component is filled with at least one salable product. The vessel is then returned to the remote site, and the salable product is unloaded.

DETAILED DESCRIPTION OF THE INVENTION

The present invention resolves the complications involved in shipping both Fischer-Tropsch products from remote production sites to developed sites and salable products from developed sites to remote sites posed by the fact that Fischer-Tropsch syncrude will be waxy and will also contain volatile components.

The following definitions will be helpful in understanding the compositions and methods described herein.

Ambient temperature: 20° C.

Boiling Range: This term refers to the 0.5 and 99.5 weight percent points as measured by ASTM (American Standard For Testing and Materials) D-2887.

Diesel fuel: A material suitable for use in diesel engines and conforming to the current version of at least one of the following specifications:

ASTM D-975, "Standard Specification for Diesel Fuel Oils"

European Grade CEN 90

Japanese Fuel Standards JIS K 2204

The United States National Conference on Weights and Measures (NCWM) 1997 guidelines for premium diesel fuel The United States Engine Manufacturers Association recommended guideline for premium diesel fuel (FQP-1A)

Distillate fuel: A material containing hydrocarbons with boiling points between about 60 and 1100° F. The term "distillate" means that typical fuels of this type can be generated from vapor overhead streams of petroleum crude distillation. In contrast, residual fuels cannot be generated from vapor overhead streams of petroleum crude distillation, and are a non-vaporizable remaining portion. Within the broad category of distillate fuels are specific fuels that include: naphtha, jet fuel, diesel fuel, kerosene, aviation gasoline, fuel oil, and blends thereof.

Fully refined wax: Fully refined wax meets FDA (Food and Drug Administration) food grade requirements as defined in Title 21 of the Code of Federal Regulations, Sections 178.3710 and 172.886. Fully refined waxes have very low odor (ASTM D-1833), oil content less than 0.5% (ASTM D-721), and a Saybolt color of +25 to +30 (ASTM D-156).

Gasoline: A material suitable for use in spark-ignition internal-combustion engines for automobiles and light trucks (motor gasoline) and piston engine aircrafts (aviation gasoline) meeting the current version of at least one of the following specifications:

ASTM D-4814 for motor gasoline

European Standard EN 228 for motor gasoline

Japanese Standard JIS K2202 for motor gasoline

ASTM D-910 for aviation gasoline

ASTM D-6227, "Standard Specification for Grade 82 Unleaded Aviation Gasoline"

UK Ministry of Defence Standard 91-90/Issue 1 (DERD 2485), GASOLINE, AVIATION: GRADES 80/87, 100/130 and 100/130 LOW LEAD Hydrocarbonaceous product: Any product containing hydrogen and carbon atoms, and may also contain heteroatoms such as oxygen, sulfur, nitrogen, and the like.

Hydroprocessing: A process wherein a hydrocarbonaceous product is contacted with hydrogen over a catalyst at pressures greater than atmospheric. Examples include hydrotreating, hydrocracking, hydroisomerization, and hydrodewaxing.

Hydrotreating: A process for removing impurities, such as elemental sulfur, nitrogen, or oxygen or compounds containing, sulfur, nitrogen, or oxygen, from a hydrocarbonaceous product mixture. Typical hydrotreating conditions vary over a wide range. In general, the overall LHSV (liquid hourly space velocity) is about 0.25 to 2.0, preferably about 0.5 to 1.0. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures range from about 300° F. to about 750° F., preferably ranging from 450° F. to 600° F.

Jet fuel: A material suitable for use in turbine engines for aircrafts or other uses meeting the current version of at least one of the following specifications:

ASTM D-1655

DEF STAN 91-91/3 (DERD 2494), TURBINE FUEL, AVIATION, KEROSINE TYPE, JET A-1, NATO CODE: F-35

International Air Transportation Association (IATA) "Guidance Material for Aviation Turbine Fuels Specifications," 4th edition, March 2000

United States Military Jet fuel specifications MIL-DTL-5624 (for JP-4 and JP-5) and MIL DTL-83133 (for JP-8)

Light hydrocarbon feedstock: These feedstocks can include methane, ethane, propane, butane and mixtures thereof. In addition, carbon dioxide, carbon monoxide, ethylene, propylene and butene may be present.

Linear hydrocarbon: The class of compounds including linear paraffins, linear olefins (internal and alpha), linear alcohols and linear acids. Members of this class of compounds above $C_{20}$, either singly or in mixtures, are typically solid or waxy at ambient temperature. Liquid linear hydrocarbons can be analyzed by gas chromatography. The concentration of linear hydrocarbons that are solids at room temperature can be determined by a solvent dewaxing method. An acceptable method involves the following: a 300-g portion of sample is dissolved in 1200 ml of 1:1 toluene-MEK (methyl ethyl ketone) solvent. Heating may be necessary to achieve complete dissolution. The solution is then cooled overnight at −15 to −20° F. to crystallize the wax. The wax crystals formed are filtered and recovered. The filtrate is vacuum distilled to separate the toluene-MEK solvent from the dewaxed oil. Occluded solvent in the wax is removed by heating the wax on a hot plate with nitrogen blowing on the surface. The weights of the recovered oil and wax are divided by the original sample weight to obtain the percent oil and percent wax.

Liquid form: This term means that at least a portion of the product is liquid, while the remainder can be solid. The portion that is liquid is at least 10%, preferably more than 25%, and most preferably more than 50%. Substantially liquid form means that at least 50%, preferably more than 75%, and most preferably more than 90%, of the product is liquid, while the remainder can be solid. It is within the scope of the methods described herein that waxy products will be completely liquid or at least a pumpable slurry upon initial loading in a transportation vessel and upon unloading the vessel. However, at least a portion may become solid during transportation as the product cools. This solid can easily be melted at the receiving end using, for example, steam heaters. However, it is most preferable that the compositions are pumpable when loaded and unloaded, and that the product does not become completely solid during transportation.

Lube base oil and lube base stock: Materials meeting the current version of the definition in API 1509.

Marine Tanker: A ship used for transporting hydrocarbons, typically, but not limited to, crude oil and refined products.

Naphtha: A light hydrocarbon fraction used in the production of gasoline, solvents and as a feedstock for ethylene production that meets at least one of the following descriptions:

ASTM D-3735, especially section on regular naphtha

Description of Naphtha in U.S. Pat. No. 6,123,834

Non-waxy: Defined by a pour point of below about 20° C. At ambient temperature or higher, will contain substantially no solid.

Paraffin: A hydrocarbon with the formula $C_nH_{2n+2}$.

Olefin: A hydrocarbon with at least one carbon-carbon double bond.

Oxygenate: A hydrocarbonaceous compound that includes at least one oxygen atom.

Remote site: A location away from a refinery or market that may have a higher cost of construction than the cost of construction at the refinery or market. In quantitative terms, the distance of transportation between the remote site and the refinery or market is at least 100 miles, preferably more than 500 miles, and most preferably more than 1000 miles.

Separately transported: This term means that at least two components are transported in separate vessels or in the same vessel with internal partitions. The vessels can include marine tankers, rail cars, pipelines, trucks, barges and the like. Thus, this may involve shipping at least two components in separate marine tankers, separate rail cars, separate pipelines, separate trucks, or separate barges. It might also involve shipping the two components by different vessels or shipping in the same marine tankers, rail cars, pipelines, trucks, or barges, but with partitions to keep the components physically separate.

Syncrude: A mixture derived from a Fischer-Tropsch process that does not meet all specifications for a finished salable product such as jet fuel, diesel fuel, lube base stock, fully refined wax, gasoline and the like, without further processing.

Transportation method: The transportation method can vary, but preferably involves using a closed vessel with no significant exposure to air during transportation. At the temperature at which the compositions are transported, the pressure inside the vessel should not exceed about 15 psia.

Transportation temperature: For materials that are fluid at ambient temperature or below, the transportation temperature is 20° C. For materials that are solid at ambient temperature, the transportation temperature is 5° C. above the pour point, preferably 10° C. above the pour point, and most preferably 20° C. above the pour point as measured by ASTM D-97.

True Vapor Pressure: A pressure expressed in psia at a defined temperature, e.g., the transportation temperature. This pressure can be measured by a number of techniques, the choice of which depends on the properties of the fraction, such as its boiling range. The suitable methods include ASTM D-2889; ASTM D-5482; ASTM D-323; ASTM D-6377-99; ASTM E-1194-87; *Engineering Data*

*Book*, Vol. I, Sections 1–16 by the Gas Processors Suppliers Association, 1994; Jentoft, R. E., Carlstrom, A. A., and Gouw, T. H., *Analytical Chemistry*, "Rapid Determination of the Vapor Pressure of Lubricating Oils and Hydraulic Fluids," 40, 1014 (1968); and the like. The true vapor pressure can also be calculated from an ASTM D-2887 distillation by converting the weight distribution into mole percent assuming a uniform UOPK (UOP characterization factor) for all fractions, estimating Antoine constants, and using Raoult's Law. The calculated pressures should be calibrated with measured values that are in excess of 1 psia. The preferred method for measuring the true vapor pressure for samples that have pour points in excess of 20° C. is the method of Jentoft et al.

Waxy: Defined by a pour point above or in excess of about 20° C. At ambient temperature, at least a portion may be solid.

The method of the invention involves converting a light hydrocarbon feedstock such as natural gas into syngas, converting the syngas into syncrude via Fischer-Tropsch synthesis, and separating the novel Fischer-Tropsch liquid syncrude into at least one waxy fraction and at least one non-waxy fraction. The fractions have true vapor pressures of less than about 15 psia, preferably less than 11 psia, when measured at their transportation temperature and contain greater than 60%, preferably greater than 75%, linear hydrocarbons by weight. The waxy fraction has a pour point in excess of 20° C., more preferably in excess of 40° C., and most preferably in excess of 60° C. It is this waxy fraction component that has created unsafe transportation conditions unless the aspect of the invention separating the syncrude into waxy and non-waxy fractions is used. At least two of the fractions, including at least one non-waxy fraction, are supplied to a vessel in substantially liquid form, wherein they are separately transported to a developed site where they are unloaded.

Natural gas is an example of a light hydrocarbon feedstock. In addition to methane, natural gas includes some heavier hydrocarbons, mostly $C_{2-5}$ paraffins, and other impurities, e.g., mercaptans and other sulfur-containing compounds, carbon dioxide, nitrogen, helium, water and non-hydrocarbon acid gases. Natural gas fields also typically contain a significant amount of $C_{5+}$ material that is liquid at ambient conditions.

The methane, and optionally ethane and/or other hydrocarbons, can be isolated and used to generate syngas. The methane in the natural gas can be isolated, for example in a demethanizer, and then de-sulfurized and sent to a syngas generator. The $C_{2+}$ products can then be separated, for example in a deethanizer, to provide ethane and a $C_{3+}$ product stream. Propane, n-butane and iso-butane can be isolated, for example in a turbo-expander, with the propane and butanes separated using a depropanizer. Various other impurities can also be readily separated. Inert impurities such as nitrogen and helium can be tolerated.

Methane, and/or ethane and heavier hydrocarbons, can be sent through a conventional syngas generator to produce syngas. Typically, syngas contains hydrogen and carbon monoxide, and may include minor amounts of carbon dioxide, water, unconverted light hydrocarbon feedstock and various other impurities. The presence of sulfur, nitrogen, halogen, selenium, phosphorus and arsenic contaminants in the syngas is undesirable. For this reason, it is preferable to remove sulfur and other contaminants from the feed before performing the Fischer-Tropsch chemistry or other hydrocarbon synthesis. Means for removing these contaminants are well known to those of skill in the art. For example, ZnO guardbeds are preferred for removing sulfur impurities. Means for removing other contaminants are well known to those of skill in the art.

The Fischer-Tropsch reaction may be effected in a fixed bed, in a slurry bed, or in a fluidized bed reactor. The Fischer-Tropsch reaction conditions include using a reaction temperature between 190° C. and 340° C., with the actual reaction temperature being largely determined by the reactor configuration. Thus, when a fluidized bed reactor is used, the reaction temperature is preferably between 300° C. and 340° C.; when a fixed bed reactor is used, the reaction temperature is preferably between 200° C. and 250° C.; and when a slurry bed reactor is used, the reaction temperature is preferably between 190° C. and 270° C.

An inlet syngas pressure to the Fischer-Tropsch reactor of between 1 and 50 bar, preferably between 15 and 50 bar, may be used. The syngas may have a $H_2$:CO molar ratio in the fresh feed of 1.5:1 to 2.5:1, preferably 1.8:1 to 2.2:1. The syngas typically includes 0.1 wppm (parts per million by weight) of sulfur or less. A gas recycle may optionally be employed to the reaction stage, and the ratio of the gas recycle rate to the fresh syngas feed rate, on a molar basis, may then be between 1:1 and 3:1, preferably between 1.5:1 and 2.5:1. A space velocity in $m^3(\text{kg catalyst})^{-1}\text{hour}^{-1}$ of 1 to 20, preferably 8 to 12, may be used in the reaction stage.

In principle, an iron-based, cobalt-based, or iron/cobalt-based Fischer-Tropsch catalyst can be used in the Fischer-Tropsch reaction stage. The iron-based Fischer-Tropsch catalyst may include iron and/or iron oxides that have been precipitated or fused. However, iron and/or iron oxides that have been sintered, cemented, or impregnated onto a suitable support can also be used. The iron should be reduced to metallic Fe before the Fischer-Tropsch synthesis. The iron-based catalyst may contain various levels of promoters, the role of which may be to alter one or more of the activity, stability and selectivity of the final catalyst.

Preferred promoters that influence the surface area of the reduced iron, "structural promoters," include oxides or metals of Mn, Ti, Mg, Cr, Ca, Si, Al, Cu, or combinations thereof.

The products from Fischer-Tropsch reactions performed in slurry bed reactors generally include a gaseous reaction product and a liquid reaction product. The gaseous reaction product includes hydrocarbons boiling below about 650° F. (e.g., tail gases through middle distillates). The liquid reaction product includes hydrocarbons boiling above about 650° F. (e.g., vacuum gas oil through heavy paraffins). The products from Fischer-Tropsch reactions performed in high temperature Fischer-Tropsch reactors are generally gaseous products that can form a liquid product when a portion of the gaseous product condenses. In one embodiment, the non-waxy fraction used in the process of the invention is derived by condensing the vapor effluent from a slurry bed Fischer-Tropsch reactor and has a boiling range from about 50 to 600° F. as measured by ASTM D-2887. In a further embodiment, the above described non-waxy fraction is blended with a slurry bed Fischer-Tropsch reactor product boiling in the range between 200 to 1100° F. as measured by ASTM D-2887 in an amount sufficient such that the mixture is liquid at 20° C.

The hydrocarbonaceous reaction product boiling below about 650° F. can be separated into a tail gas fraction and a condensate fraction, i.e., about $C_5$ to $C_{20}$ normal paraffins and higher boiling hydrocarbons, using, for example, a high pressure and/or lower temperature vapor-liquid separator, low pressure separators, or a combination of separators. The hydrocarbonaceous reaction product boiling above about 650° F. primarily contains $C_{20}$ to $C_{50}$ linear paraffins with relatively small amounts of higher boiling branched paraffins.

If a $C_{5+}$ fraction is isolated from a Fischer-Tropsch synthesis performed under conditions that favor formation of wax and heavy products, rather than methane and light ($C_{3-8}$) products, the fraction is likely to be solid at room temperature. In the methods described herein, the $C_{5+}$ fraction is transported in molten form. However, at the temperature at which the fraction is molten, lighter hydrocarbons (roughly between about $C_5$ and $C_{14-20}$) are volatile. If the light and heavy hydrocarbons are transported together in a sealed container in the molten state, the resulting pressure would exceed the specifications for most methods of transportation. This problem is overcome by removing volatile hydrocarbons that would raise the pressure above about 15 psia, more preferably above 11 psia, at the transportation temperature. As a result, in one embodiment the waxy fraction of the invention has a true vapor pressure that is greater than that of molten wax but less than about 15 psia when measured at its transportation temperature and a pour point in excess of 40° C. In a further embodiment, the above described waxy fraction contains greater than 75% linear hydrocarbons by weight and has a true vapor pressure between 0.03 and 4 psia when measured at its transportation temperature.

A $C_{1-2}$ fraction can also be isolated from the Fischer-Tropsch synthesis and recycled upstream of syngas generation, flared, used to produce hydrogen and/or used for fuel. A $C_3$-enriched fraction, including more than 5% by weight $C_3$, preferably more than 20% by weight $C_3$, and most preferably more than 40% by weight $C_3$, can also be obtained. This fraction can be recycled upstream of syngas generation, flared, used for fuel, transported in pressurized tankers, and/or transported in refrigerated tankers.

An LPG (liquified petroleum gas) fraction can also be isolated. The LPG fractions preferably include mostly $C_{3-5}$ hydrocarbons, and preferably include mostly propane, n-butane and iso-butane. They may also contain small amounts of pentanes and less preferably, $C_{3-5}$ olefins. In a preferred embodiment, the LPG fraction is primarily a propane-rich and/or butane-rich product stream, as such streams are known in the art, and is suitable for all possible end uses, for example, as an alternative fuel source for automobiles. Most preferably, the composition falls within the stringent specifications for LPG product streams in conventional LPG fuel use and alternative fuel use. The LPG fraction may include an appreciable amount of olefins and/or oxygenates, which may be hydrotreated to form paraffins. In a preferred LPG product, the amount of ethane is less than about five percent by volume of the mixture, propylene less than about one percent by volume of propane, and butylene less than about one percent by volume of butane. $C_{5+}$ hydrocarbons are preferably less than about twenty five percent by volume of the mixture. The sulfur content is preferably less than about 150 ppm (parts per million).

The LPG fraction can be transported at a temperature at which the volatility does not exceed commercial specifications (i.e., less than about 15 psia, preferably less than 11 psia). LPG generally has a pressure of about 120 psia at ambient temperatures, so it must be cooled when shipped to meet such specifications unless it is shipped under pressure in commercial transportation means that do not have such specifications.

In one embodiment, individual propane and butane streams are isolated rather than LPG. This can be accomplished, for example, by passing a mixture including $C_{1-4}$ hydrocarbons through a demethanizer, deethanizer and depropanizer. The first fractions collected from the cooling of the gaseous reaction product from Fischer-Tropsch synthesis tend to have higher average molecular weights than subsequent fractions. A $C_{14-20}$ fraction can be isolated and combined with the liquid reaction products to form a $C_{14+}$ syncrude. A $C_{14-20}$ fraction can also be obtained by removing the $C_{5-13}$ hydrocarbons from the $C_{14+}$ products by distillation after the middle distillate fraction is collected.

The vapor pressure of the composition can be measured at the transportation temperature using techniques well known to those in the art. If the vapor pressure of the composition exceeds specifications at the transportation temperature, lower boiling hydrocarbons can be removed from the composition, for example via vacuum distillation or other suitable means known to those of skill in the art.

A $C_5$ to $C_{14-20}$ fraction can also be obtained and shipped at a temperature at which the volatility does not exceed commercial specifications. The $C_5$ to $C_{14-20}$ fraction can be transported at temperatures around and above ambient, although generally, temperatures in excess of 200° C., and more preferably 100° C., should be avoided. If the material is liquid or at least a pumpable slurry at or around ambient temperature, temperatures around ambient temperature are preferred.

The fractions described above can optionally be combined with hydrocarbons from other streams, although such hydrocarbons should not elevate the pressure of the composition above about 15 psia at the transportation temperature. For example, an LPG can be mixed with an LPG obtained from a natural gas field. A $C_5$ to $C_{14-20}$ fraction can be combined with a similar fraction obtained from the fractional distillation of crude oil. Syncrude can be combined with waxy crude oils, crude oils and/or slack waxes from petroleum deoiling and dewaxing operations.

By way of example, the vapor pressure of two commercial low molecular weight waxy foots oils derived from petroleum processing were determined by use of the procedures described by Jentoft et al. These oils are typically stored and shippped at 180° F. The first foots oil (142 Foots Oil) was a product from the manufacture of a 140° F. melting point wax. The second (Cut 1A) was a distilled product, lighter than the lowest melting point wax produced, a 126° F. melting point wax. Thus, 142 Foots Oil represents a typical mid-range waxy product and Cut 1A represents the lightest and most volatile product expected in current commercial transportation of waxy petroleum oils and waxes. The true vapor pressure results (in psia) for these samples are shown below:

| Temperature of Measurement, ° F. | 142 Foots Oil | Cut 1A |
|---|---|---|
| 100 | 0.00 | 0 |
| 200 | 0.00 | 0.0004 |
| 300 | 0.0004 | 0.0269 |
| 400 | 0.0162 | 0.751 |
| 500 | 0.288 | 10.48 |

Since commercial shipping temperatures for wax never exceed 300° F., and rarely exceed 200° F., the maximum true vapor pressure for transportation of molten wax products of this type is at most 0.03 psia (corresponding to Cut 1A). It is not necessary to prepare and ship syncrude blends with this very low true vapor pressure because higher pressures are within acceptable limits and can be used to effectively transport more product, e.g., the more volatile components, in a common compartment. As a result, blends with pressures between 0.03 and 4 psia will maximize the amount of blended product while maintaining acceptable pressures.

In particularly preferred embodiments, syncrude blends having pour points of about 80° C. which are shipped at temperatures greater than 20° C., e.g., shipped at 100° C., will have true vapor pressures of less than 3.8 psia to minimize cargo loss and enhance safety. Petroleum products such as crude oil can be blended with one or more of the transportable Fischer-Tropsch products, so long as the resulting blended composition meets the required specifications. Of course, selecting blends with even lower vapor pressures further enhances safety and minimizes cargo loss. Selecting the lowest possible shipping temperatures and pressures less than 1 psia for blends with pour points in excess of 20° C. is most desirable.

Streams that may be shipped using the present process include an emulsion comprising a Fischer-Tropsch product and a second phase. The second phase is preferably selected from the group consisting of water and methanol. Water that may be included in the emulsion may be derived from a Fischer-Tropsch process. By way of example, the water may be derived from the Fischer-Tropsch reaction as a by-product or from the cooing water. The emulsion may further include additional materials, which may, for example, maintain the integrity of the emulsion. By way of example, one or more surfactant materials, which are known in the art, are a suitable example of such an additional material.

The products can be transported using any commonly used means of transportation, including marine tankers, rail cars, pipelines, trucks, barges and combinations thereof. A preferred means of transportation is a marine tanker. Whether transported by marine tanker, rail, truck, and/or barge, each transportable product is transported either in a separate marine tanker, rail, truck, or barge, or in a separate zone, isolated by internal partitions, for each transportable product within the same marine tanker, rail, truck, or barge. Each zone within a means of transportation or each separate means of transportation should have the ability to control the temperature such that each product can meet the desired pressure specifications. Accordingly, the means of transportation should be able to either cool any LPG fractions that are transported, or alternatively, be able to safely handle elevated pressures, maintain any $C_5$ to $C_{14-20}$ fractions at or around room temperature and maintain the syncrude at a temperature at which it is molten, at least while the product is being pumped into or out of the transportation means. This temperature is generally at least 5° C. above the pour point, preferably 10° C. above the pour point, but in any event, no more than 250° C., more preferably less than 200° C., and most preferably less than 150° C.

After unloading the separate fractions at the developed site, at least one vessel or portion of a vessel that contained a non-waxy component is filled with at least one salable product. Salable products will become unacceptable if they are allowed to come in contact with waxy syncrudes, such as those from a Fischer-Tropsch process. To produce a Fischer-Tropsch syncrude at a remote site, ship it safely, and supply salable products to a remote site requires a special procedure. The shipping of the salable product in the portion of the vessel that carried the non-waxy components on the inbound route avoids the contamination that would otherwise occur. The vessel is then returned to the remote site, and the salable product is unloaded.

While Fischer-Tropsch syncrude contains fewer heteroatom contaminants, such as sulfur, nitrogen, and heavy metals, than does crude oil, the non-waxy fraction of the Fischer-Tropsch syncrude will contain traces of oxygenates (alcohols and small amounts of acids) along with olefins. The non-waxy components may also contain material that is excessively volatile in comparison to the acceptable product flash point specifications. Care can be taken to minimize the contamination of the salable product by the non-waxy component by designing and using transportation vessels that can be emptied substantially completely, flushing the transportation vessel(s) or portion(s) thereof which contained the non-waxy fraction(s) with a solvent that can be a sacrificial portion of the salable product, and/or cleaning the transportation vessel(s) or portion(s) thereof which contained the non-waxy fraction(s) with steam.

However, if the salable product does become contaminated, it can be de-contaminated by adsorbing the oxygenates and olefins using an adsorbent such as alumina, hydrotreating the product to remove oxygenates and olefins, extracting the product with a solvent to remove oxygenates and olefins, or stripping volatile contaminants in a distillation column, optionally with added steam.

It should also be recognized that at least one more site may be used in this approach. For example, the Fischer-Tropsch syncrude could be produced at one remote site and shipped to a developed site where the syncrude is unloaded and then the vessel loaded with salable product. The vessel could then go to at least one other remote site to supply at least a portion of the salable product, and then continue back to the first remote site.

Those skilled in the art will recognize or be able to ascertain using no more than routine experimentation many equivalents to the specific embodiments of the invention described herein. Such equivalents are intended to be encompassed by the following claims.

What is claimed is:

1. A process for manufacturing and transporting Fischer-Tropsch syncrude comprising:

a) converting a light hydrocarbon feedstock into syngas;

b) converting at least a portion of the syngas into syncrude via Fischer-Tropsch synthesis;

c) separating the syncrude into at least one waxy fraction at 20° C. and at least one non-waxy fraction at 20° C., wherein all fractions have true vapor pressures of less than about 15 psia when measured at their transportation temperature and contain greater than 60% linear hydrocarbons by weight;

d) separately transporting the waxy and non-waxy fractions in liquid form in one or more transportation vessels from a first site to at least one second site;

e) unloading at least the non-waxy fraction of step (d) at at least one second site; and f) loading at least one finished salable product into the transportation vessel or portion thereof which contained the non-waxy fraction.

2. The process according to claim 1 wherein the finished salable product is selected from the group consisting of gasoline, jet fuel, diesel fuel, lube base stock, lube base oil, formulated lubricant, benzene, toluene, and xylene.

3. The process according to claim 1 further including materials blended in the waxy fraction selected from the group consisting of crude petroleum, petroleum fractions, products derived from petroleum, and mixtures thereof.

4. The process according to claim 1 wherein all fractions have true vapor pressures of less than 11 psia when measured at their transportation temperature.

5. The process according to claim 4 wherein all fractions have true vapor pressures of 0.03 to 4 psia when measured at their transportation temperature.

6. The process according to claim 4 wherein all fractions contain greater than 75% linear hydrocarbons by weight.

7. The process according to claim 1 wherein the waxy fraction has a true vapor pressure that is greater than that of molten wax but less than about 15 psia when measured at its transportation temperature and a pour point in excess of 40° C.

8. The process according to claim 1 wherein the waxy fraction contains greater than 75% linear hydrocarbons by weight and has a true vapor pressure between 0.03 and 4 psia when measured at its transportation temperature.

9. The process according to claim 8 wherein the non-waxy fraction is derived by condensing the vapor effluent from a slurry bed Fischer-Tropsch reactor and has a boiling range from about 50 to 600° F. as measured by ASTM D-2887.

10. The process according to claim 9 further comprising blending the non-waxy fraction with a slurry bed Fischer-Tropsch reactor product boiling in the range between 200 to 1100° F. as measured by ASTM D-2887 in an amount sufficient such that the mixture is liquid at 20° C.

11. The process according to claim 7 further including materials blended in the waxy fraction selected from the group consisting of crude petroleum, petroleum fractions, products derived from petroleum, and mixtures thereof.

12. The process according to claim 1 wherein the transportation vessel is selected from the group consisting of marine tanker, rail car, pipeline, truck, barge, and combinations thereof.

13. The process according to claim 12 wherein each fraction is separately transported.

14. The process according to claim 1 further comprising minimizing contamination of the salable product by the non-waxy component by using transportation vessels that can be emptied substantially completely.

15. The process according to claim 1 further comprising minimizing contamination of the salable product by the non-waxy component by flushing the transportation vessel (s) or portion(s) thereof which contained the non-waxy fraction(s) with a solvent.

16. The process according to claim 15 wherein the solvent is a sacrificial portion of the salable product.

17. The process according to claim 1 further comprising minimizing contamination of the salable product by the non-waxy component by cleaning the transportation vessel (s) or portion(s) thereof which contained the non-waxy fraction(s) with steam.

18. The process according to claim 1 further comprising removing oxygenates and olefins from a contaminated salable product by adsorption.

19. The process according to claim 1 further comprising removing oxygenates and olefins from a contaminated salable product by hydrotreating.

20. The process according to claim 1 further comprising removing oxygenates and olefins from a contaminated salable product by extraction with a solvent.

21. The process according to claim 1 further comprising stripping volatile contaminants from a contaminated salable product by distillation.

22. A process for transporting Fischer-Tropsch syncrude comprising:

a) separating the syncrude into at least one waxy fraction at 20° C. and at least one non-waxy fraction at 20° C., wherein all fractions have true vapor pressures of less than about 15 psia when measured at their transportation temperature and contain greater than 60% linear hydrocarbons by weight;

b) separately transporting the waxy and non-waxy fractions in liquid form in one or more transportation vessels to at least one second site;

c) unloading at least the non-waxy fraction of step (b) at at least one second site; and d) loading at least one finished salable product into the transportation vessel or portion thereof which contained the non-waxy fraction.

23. A process for transporting a finished salable product including at least one first site and at least one second site, remote from each other, wherein one or a plurality of said first sites produce a transportable Fischer-Tropsch syncrude and at least one or a plurality of said second sites produce a finished salable product, the process comprising:

a) receiving at the second site the transportable Fischer-Tropsch syncrude, separated into at least one waxy fraction at 20° C. and at least one non-waxy fraction at 20° C., wherein all fractions have true vapor pressures of less than about 15 psia when measured at their transportation temperature, which are made by a method comprising:

i) converting a light hydrocarbon feed to syngas, ii) converting at least a portion of the syngas into syncrude via Fischer-Tropsch synthesis;

iii) separating the Fischer-Tropsch syncrude into the fractions;

b) unloading at least the non-waxy fraction; and c) loading at least one finished salable product into the transportation vessel or portion of the transportation vessel which contained the non-waxy fraction.

24. The process according to claim 23 wherein the finished salable product is selected from the group consisting of gasoline, jet fuel, diesel fuel, lube base stock, lube base oil, formulated lubricant, benzene, toluene, and xylene.

25. The process according to claim 24 wherein the finished salable product is at least partially made from at least one of the received fractions of step (a).

26. The process according to claim 24 wherein the finished salable product is delivered to a site other than the one or plurality of first sites which produced the transportable Fischer-Tropsch syncrude, prior to returning to the one or plurality of first sites.

27. The process according to claim 24 wherein the finished salable product is delivered to the one or plurality of first sites which produced the transportable Fischer-Tropsch syncrude.

* * * * *